US011508294B2

(12) United States Patent
Zhao et al.

(10) Patent No.: US 11,508,294 B2
(45) Date of Patent: Nov. 22, 2022

(54) PIXEL CIRCUIT, PIXEL DRIVING METHOD AND DISPLAY DEVICE

(71) Applicant: BOE Technology Group Co., Ltd., Beijing (CN)

(72) Inventors: Jiao Zhao, Beijing (CN); Seungwoo Han, Beijing (CN); Haoliang Zheng, Beijing (CN); Minghua Xuan, Beijing (CN); Li Xiao, Beijing (CN); Dongni Liu, Beijing (CN); Liang Chen, Beijing (CN); Hao Chen, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/530,101

(22) Filed: Nov. 18, 2021

(65) Prior Publication Data

US 2022/0293038 A1 Sep. 15, 2022

(30) Foreign Application Priority Data

Mar. 15, 2021 (CN) ..... 202110275834.3

(51) Int. Cl.
*G09G 3/32* (2016.01)

(52) U.S. Cl.
CPC ..... *G09G 3/32* (2013.01); *G09G 2300/0842* (2013.01); *G09G 2310/0275* (2013.01)

(58) Field of Classification Search
CPC ..... G09G 3/32; G09G 2300/0842; G09G 2310/0275
See application file for complete search history.

(56) References Cited

U.S. PATENT DOCUMENTS

| | | | | |
|---|---|---|---|---|
| 10,878,734 | B1 * | 12/2020 | Watsuda | G09G 3/3233 |
| 2013/0069852 | A1 | 3/2013 | Liao et al. | |
| 2016/0133187 | A1 | 5/2016 | Li et al. | |
| 2016/0189606 | A1 * | 6/2016 | Chen | G09G 3/3659 345/78 |
| 2018/0130411 | A1 * | 5/2018 | Zhou | G09G 3/3225 |
| 2018/0130419 | A1 * | 5/2018 | He | G09G 3/3258 |
| 2018/0240405 | A1 * | 8/2018 | Li | G09G 3/3258 |
| 2019/0244578 | A1 * | 8/2019 | Wu | G06F 3/0416 |

(Continued)

FOREIGN PATENT DOCUMENTS

| | | | |
|---|---|---|---|
| CN | 103165080 | A | 6/2013 |
| CN | 104575378 | A | 4/2015 |

(Continued)

OTHER PUBLICATIONS

CN 202110275834.3 first office action.

*Primary Examiner* — Andrew Sasinowski
(74) *Attorney, Agent, or Firm* — IPro, PLLC

(57) ABSTRACT

The present application provides a pixel circuit, a pixel driving method and a display device. The pixel circuit is to be coupled to a to-be-driven element. The pixel circuit includes a first energy storage circuit, a driving circuit, a light-emitting control circuit, a data writing circuit, and a compensation control circuit. The compensation control circuit is configured to, under control of a third control signal, control conduction between the first node and the first terminal of the driving circuit, and control conduction between the second node and the second terminal of the driving circuit.

20 Claims, 5 Drawing Sheets

(56) References Cited

U.S. PATENT DOCUMENTS

| | | | | |
|---|---|---|---|---|
| 2019/0347988 | A1* | 11/2019 | Zhang | G09G 3/3233 |
| 2019/0362674 | A1* | 11/2019 | Xu | G09G 3/3241 |
| 2020/0327855 | A1* | 10/2020 | Lin | G09G 3/32 |
| 2020/0342813 | A1 | 10/2020 | Gao et al. | |

FOREIGN PATENT DOCUMENTS

| | | | |
|---|---|---|---|
| CN | 109036270 | A | 12/2018 |
| CN | 110890056 | A | 3/2020 |

* cited by examiner

PIXEL CIRCUIT, PIXEL DRIVING METHOD AND DISPLAY DEVICE

CROSS-REFERENCE TO RELATED APPLICATIONS

The present application claims a priority to the Chinese patent application No. 202110275834.3 filed in China on Mar. 15, 2021, a disclosure of which is incorporated herein by reference in its entirety.

TECHNICAL FIELD

The present application relates to the field of display technologies, and in particular to a pixel circuit, a pixel driving method and a display device.

BACKGROUND

The indium gallium zinc oxide (IGZO) technology has better uniformity in large-size display devices than the low temperature polysilicon (LTPS) technology, and has higher mobility than the amorphous silicon (a-Si) technology. In the related art, display devices made with the IGZO technology usually use external compensation for pixel driving. At this point, structures of a pixel circuit are simple, but complex external compensation circuits and integrated circuits (ICs) are required for external compensation, resulting in high production cost.

SUMMARY

In a first aspect, one embodiment of the present disclosure provides a pixel circuit configured to be coupled to a to-be-driven element, including: a first energy storage circuit, a driving circuit, a light-emitting control circuit, a data writing circuit and a compensation control circuit.

A first terminal of the first energy storage circuit is electrically coupled to a first node; a second terminal of the first energy storage circuit is electrically coupled to a second node; the first energy storage circuit is configured to store electric energy; the first node is electrically coupled to a control terminal of the driving circuit.

The light-emitting control circuit is respectively coupled to a first control terminal, a second control terminal, a first terminal of the driving circuit, a second terminal of the driving circuit, a first terminal of the to-be-driven element and a first voltage terminal; the light-emitting control circuit is configured to, control conduction between the first terminal of the to-be-driven element and the first terminal of the driving circuit under control of a first control signal provided by the first control terminal, and control conduction between the second terminal of the driving circuit and the first voltage terminal under control of a second control signal provided by the second control terminal; the second terminal of the to-be-driven element is electrically coupled to a second voltage terminal.

The compensation control circuit is electrically coupled to a third control terminal, the first node, the first terminal of the driving circuit, the second node and the second terminal of the driving circuit, respectively; the compensation control circuit is configured to, under control of a third control signal provided by the third control terminal, control conduction between the first node and the first terminal of the driving circuit, and control conduction between the second node and the second terminal of the driving circuit.

The data writing circuit is electrically coupled to a fourth control terminal, a data line and the second node, respectively; the data writing circuit is configured to, under control of a fourth control signal provided by the fourth control terminal, control writing a data voltage provided by the data line into the second node.

The driving circuit is configured to, under control of a potential of the control terminal of the driving circuit, generate a driving current.

Optionally, the pixel circuit further includes a second energy storage circuit; wherein a first terminal of the second energy storage circuit is electrically coupled to the second node; a second terminal of the second energy storage circuit is electrically coupled to a third voltage terminal; and the second energy storage circuit is configured to store electrical energy.

Optionally, the compensation control circuit includes a first transistor and a second transistor; a control terminal of the first transistor is electrically coupled to the third control terminal; a first terminal of the first transistor is electrically coupled to the second node; a second terminal of the first transistor is electrically coupled to the second terminal of the driving circuit; a control terminal of the second transistor is electrically coupled to the third control terminal; a first terminal of the second transistor is electrically coupled to the first node; a second terminal of the second transistor is electrically coupled to the first terminal of the driving circuit.

Optionally, the light-emitting control circuit includes a third transistor and a fourth transistor; a control terminal of the third transistor is electrically coupled to the first control terminal; a first terminal of the third transistor is electrically coupled to the first terminal of the to-be-driven element; a second terminal of the third transistor is electrically coupled to the first terminal of the driving circuit; a control terminal of the fourth transistor is electrically coupled to the second control terminal; a first terminal of the fourth transistor is electrically coupled to the second terminal of the driving circuit; a second terminal of the fourth transistor is electrically coupled to the first voltage terminal.

Optionally, the data writing circuit includes a fifth transistor; a control terminal of the fifth transistor is electrically coupled to the fourth control terminal; a first terminal of the fifth transistor is electrically coupled to the data line; a second terminal of the fifth transistor is electrically coupled to the second node.

Optionally, the driving circuit includes a driving transistor; the first energy storage circuit includes a first storage capacitor; and the second energy storage circuit includes a second storage capacitor; a control terminal of the driving transistor is the control terminal of the driving circuit; a first terminal of the driving transistor is the first terminal of the driving circuit; a second terminal of the driving transistor is the second terminal of the driving circuit; a first terminal of the first storage capacitor is electrically coupled to the first node; a second terminal of the first storage capacitor is electrically coupled to the second node; a first terminal of the second storage capacitor is electrically coupled to the second node; a second terminal of the second storage capacitor is electrically coupled to the third voltage terminal.

Optionally, the to-be-driven element is a micro light-emitting diode.

Optionally, the compensation control circuit includes a first transistor and a second transistor; the light-emitting control circuit includes a third transistor and a fourth transistor; the data writing circuit includes a fifth transistor; and the driving circuit includes a driving transistor; the first transistor, the second transistor, the third transistor, the fourth transistor, the fifth transistor, and the driving transistor are all be n-type transistors.

In a second aspect, one embodiment of the present disclosure provides a driving method applied to the foregoing pixel circuit, wherein an operation period includes a compensation phase, a data writing phase, and a light-emitting phase which are sequentially arranged; the method includes:

in the compensation phase, storing a threshold voltage of the driving transistor in the driving circuit in the first energy storage circuit under control of the compensation control circuit;

in the data writing phase, controlling, by the data writing circuit under control of the fourth control signal, writing a data voltage into the second node;

in the light-emitting phase, controlling, by the light-emitting control circuit under control of the first control signal, conduction between the first terminal of the to-be-driven element and the first terminal of the driving circuit, and controlling, by the light-emitting control circuit under control of the second control signal, conduction between the second terminal of the driving circuit and the first voltage terminal, thereby enabling the driving circuit to generate a driving current for driving the to-be-driven element.

Optionally, the method further includes: in the compensation phase, controlling, by the light-emitting control circuit under control of the first control signal, conduction between the first terminal of the to-be-driven element and the first terminal of the driving circuit;

wherein the step of in the compensation phase, storing a threshold voltage of the driving transistor in the driving circuit in the first energy storage circuit under control of the compensation control circuit, includes:

controlling, by the compensation control circuit under control of the third control signal, conduction between the first node and the first terminal of the driving circuit and conduction between the second node and the second terminal of the driving circuit, thereby enabling a potential of the second node to be related to the threshold voltage of the driving transistor, and storing the threshold voltage of the driving transistor in the first energy storage circuit.

Optionally, the operation period further includes an initialization phase before the compensation phase; the method further includes: in the initialization phase, controlling, by the light-emitting control circuit under control of the first control signal, conduction between the first terminal of the to-be-driven element and the first terminal of the driving circuit, and controlling, by the light-emitting control circuit under control of the second control signal, conduction between the second terminal of the driving circuit and the first voltage terminal.

Optionally, the step of in the compensation phase, storing a threshold voltage of the driving transistor in the driving circuit in the first energy storage circuit under control of the compensation control circuit, includes:

in the compensation phase, controlling, by the compensation control circuit under control of the third control signal, conduction between the first node and the first terminal of the driving circuit and conduction between the second node and the second terminal of the driving circuit, thereby controlling, in the compensation phase, the driving circuit to turn on connection between the first terminal of the driving circuit and the second terminal of the driving circuit to discharge the first energy storage circuit, until the driving circuit disconnects the connection between the first terminal of the driving circuit and the second terminal of the driving circuit to store the threshold voltage in the first energy storage circuit.

Optionally, the operation period further includes an initialization phase before the compensation phase; the method further includes:

in the initialization phase, controlling, by the light-emitting control circuit under control of the first control signal, conduction between the first terminal of the to-be-driven element and the first terminal of the driving circuit, and controlling, by the compensation control circuit under control of the third control signal, conduction between the first node and the first terminal of the driving circuit and conduction between the second node and the second terminal of the driving circuit, thereby initializing a potential of the first node and a potential of the second node.

In a third aspect, one embodiment of the present disclosure provides a display device including the foregoing pixel circuit.

The pixel circuit, the pixel driving method and the display device in the embodiment of the present application can realize compensation of a threshold voltage of a driving transistor included in the driving circuit, thereby realizing internal compensation function with simple driving sequence. Compared with the external compensation pixel circuit in the related art, the use of complex external compensation circuits can be avoided, and the use of ICs can be reduced, thereby reducing manufacturing cost.

Additional aspects and advantages of the present application will be given in the following description, which will become apparent from the following description, or be understood through practice of the present application.

BRIEF DESCRIPTION OF THE DRAWINGS

The foregoing and/or additional aspects and advantages of the present application will become apparent and easy to understand from the following description of the embodiments in conjunction with the accompanying drawings, in which.

DETAILED DESCRIPTION

Figure 1:
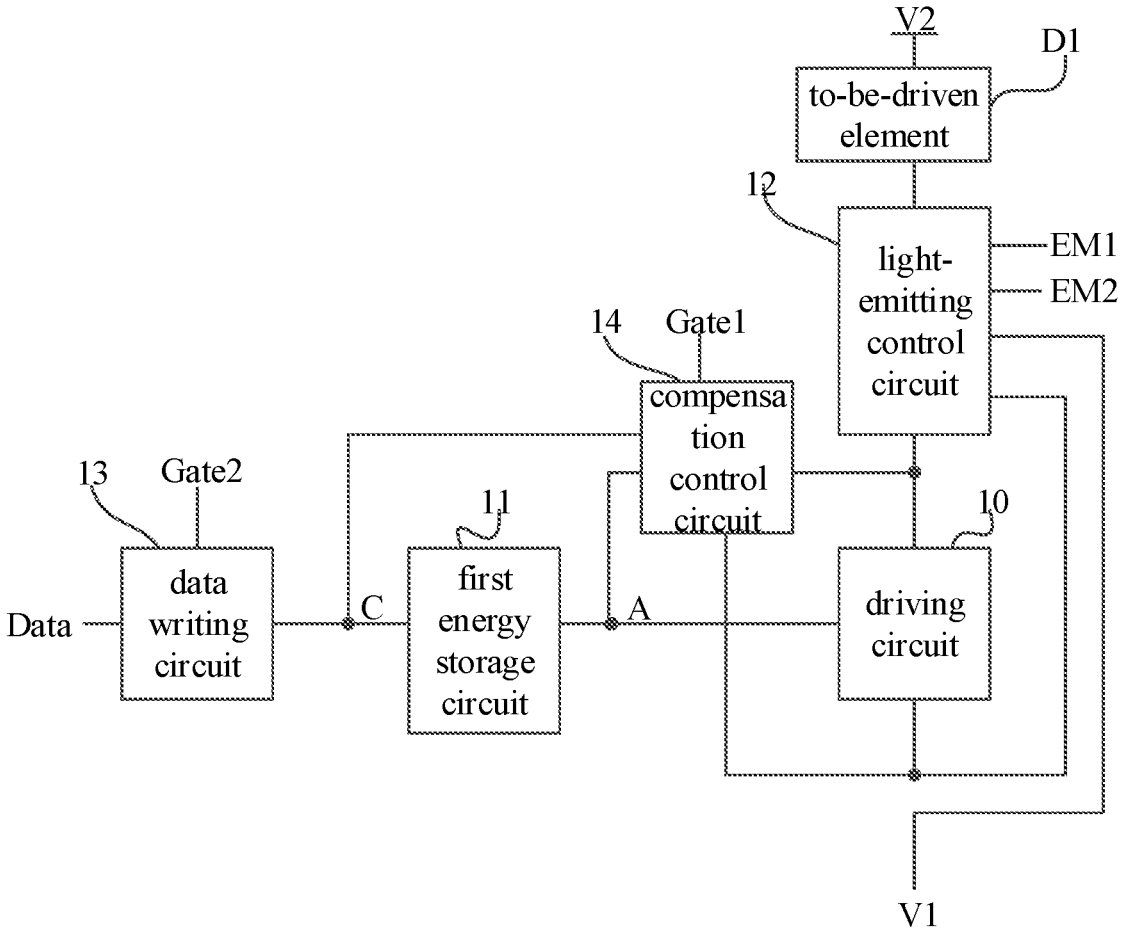
FIG. 1 is a schematic diagram of a pixel circuit according to an embodiment of the present disclosure.

The present disclosure is described in detail below. Examples of embodiments of the present disclosure are shown in the drawings, where the same or similar reference numerals indicate the same or similar components or components having the same or similar functions. Further, if detailed descriptions of known technologies are unnecessary for the illustrated features of the present disclosure, they are omitted. The embodiments described below with reference to the drawings are exemplary, and only used to explain the present disclosure, and cannot be construed as limiting the present disclosure.

Transistors used in all embodiments of the present application may be triodes, thin film transistors, field effect transistors, or other devices with the same characteristics. In the embodiment of the present application, in order to distinguish two electrodes of the transistor other than a control terminal, one of the two electrodes is referred as a first terminal, and the other one of the two electrode is referred as a second terminal.

In actual operation, when the transistor is a triode, the control terminal may be a base electrode, the first terminal may be a collector electrode, and the second terminal may be an emitter electrode; or, the control terminal may be a base electrode, the first terminal may be an emitter electrode, and the second terminal may be a collector electrode.

In actual operation, when the transistor is a thin film transistor or a field effect transistor, the control terminal may be a gate electrode, the first terminal may be a drain electrode, and the second terminal may be a source electrode; or the control terminal may be a gate electrode, the first terminal may be a source electrode, and the second terminal may be a drain electrode.

As shown in FIG. 1, a pixel circuit according to an embodiment of the present application is configured to be coupled to a to-be-driven element D1 and provide an electric signal to the to-be-driven element Dl. The pixel circuit includes a first energy storage circuit 11, a driving circuit 10, a light-emitting control circuit 12, a data writing circuit 13, and a compensation control circuit 14.

A first terminal of the first energy storage circuit 11 is electrically coupled to a first node A. A second terminal of the first energy storage circuit 11 is electrically coupled to a second node C. The first energy storage circuit 11 is configured to store electric energy. The first node A is electrically coupled to a control terminal of the driving circuit 10.

The light-emitting control circuit 12 is respectively coupled to a first control terminal EM1, a second control terminal EM2, a first terminal of the driving circuit 10, a second terminal of the driving circuit 10, a first terminal of the to-be-driven element D1 and a first voltage terminal V1. The light-emitting control circuit 12 is configured to, control conduction between the first terminal of the to-be-driven element D1 and the first terminal of the driving circuit 10 under control of a first control signal provided by the first control terminal EM1, and control conduction between the second terminal of the driving circuit 10 and the first voltage terminal V1 under control of a second control signal provided by the second control terminal EM2. The second terminal of the to-be-driven element D1 is electrically coupled to the second voltage terminal V2.

The compensation control circuit 14 is electrically coupled to a third control terminal Gate1, the first node A, the first terminal of the driving circuit 10, the second node C and the second terminal of the driving circuit 10, respectively. The compensation control circuit 14 is configured to, under control of a third control signal provided by the third control terminal Gate1, control conduction between the first node A and the first terminal of the driving circuit 10, and control conduction between the second node C and the second terminal of the driving circuit 10.

The data writing circuit 13 is electrically coupled to a fourth control terminal Gate2, a data line Data and the second node C, respectively. The data writing circuit 13 is configured to, under control of a fourth control signal provided by the fourth control terminal Gate2, control writing a data voltage provided by the data line Data into the second node C.

The driving circuit 10 is configured to, under control of a potential of its control terminal, generate a driving current for driving the to-be-driven element D1.

In at least one embodiment of the present application, the first voltage terminal V1 may be a low voltage terminal, and the second voltage terminal V2 may be a high voltage terminal, which is not limited thereto.

The pixel circuit in the embodiment of the present application can realize compensation of a threshold voltage of a driving transistor included in the driving circuit, thereby realizing internal compensation function with simple driving sequence. Compared with the external compensation pixel circuit in the related art, the use of complex external compensation circuits can be avoided, and the use of ICs can be reduced, thereby reducing manufacturing cost.

In at least one embodiment of the present application, the to-be-driven element may be a light-emitting element. The light-emitting element may be a micro light-emitting diode (LED). In this case, the first terminal of the to-be-driven element may be a cathode, and the second terminal of the to-be-driven element may be an anode, but is not limited to this. In actual operation, the light-emitting element may also be an organic light-emitting diode.

In one specific implementation, the driving circuit may include a driving transistor. A control terminal of the driving transistor is the control terminal of the driving circuit. A first terminal of the driving transistor is the first terminal of the driving circuit. A second terminal of the driving transistor is the second terminal of the driving circuit.

In related art, micro light-emitting diodes have excellent display performance. The micro light-emitting diodes are bonded on a driving backplane through massive transfer, so that they have a greater advantage in large-size display technology and can produce super-large screens. At present, indium gallium zinc oxide (IGZO) transistors perform better in super-large display screens. Generally, the IGZO transistor is an n-type transistor.

When one embodiment of the pixel circuit shown in FIG. 1 of the present application is in operation, an operation period may include an initialization phase, a compensation phase, a data writing phase, and a light-emitting phase which are sequentially arranged.

In the initialization phase, the light-emitting control circuit 12 controls conduction between the first terminal of the to-be-driven element D1 and the first terminal of the driving circuit 10 under control of the first control signal, and the light-emitting control circuit 12 controls conduction between the second terminal of the driving circuit 10 and the first voltage terminal V1 under control of the second control signal, thereby initializing a potential of the first terminal of the driving circuit 10 and a potential of the second terminal of the driving circuit 10.

In the compensation phase, the light-emitting control circuit 12 controls conduction between the first terminal of the to-be-driven element D1 and the first terminal of the driving circuit 10 under control of the first control signal; the compensation control circuit 14, under control of the third control signal, controls conduction between the first node A and the first terminal of the driving circuit 10 and controls conduction between the second node C and the second terminal of the driving circuit 10, thereby enabling a potential of the second node C to be related to a threshold voltage of the driving transistor, and storing the threshold voltage of the driving transistor in the first energy storage circuit 11.

In the data writing phase, the data writing circuit 13 controls writing a data voltage on the data line Data into the second node C under control of the fourth control signal, thereby correspondingly changing the potential of the first node A.

In the light-emitting phase, the light-emitting control circuit 12 controls conduction between the first terminal of the to-be-driven element D1 and the first terminal of the driving circuit 10 under control of the first control signal, and the light-emitting control circuit 12 controls conduction between the second terminal of the driving circuit 10 and the first voltage terminal V1 under control of the second control signal, thereby enabling the driving circuit 10 to generate a driving current for driving the to-be-driven element D1.

When one embodiment of the pixel circuit shown in FIG. 1 of the present application is in operation, an operation period may include an initialization phase, a compensation phase, a data writing phase, and a light-emitting phase which are sequentially arranged.

In the initialization phase, the light-emitting control circuit 12 controls conduction between the first terminal of the to-be-driven element D1 and the first terminal of the driving circuit 10 under control of the first control signal, the compensation control circuit 14, under control of the third control signal, controls conduction between the first node A and the first terminal of the driving circuit 10 and controls conduction between the second node C and the second terminal of the driving circuit 10, thereby initializing a potential of the first node A and a potential of the second node C.

In the compensation phase, the compensation control circuit 14, under control of the third control signal, controls conduction between the first node A and the first terminal of the driving circuit 10 and controls conduction between the second node C and the second terminal of the driving circuit 10, thereby controlling, in the compensation phase, the driving circuit 10 to turn on connection between the first terminal of the driving circuit 10 and the second terminal of the driving circuit 10 to discharge the first energy storage circuit 11, until the driving circuit 10 disconnects the connection between the first terminal of the driving circuit 10 and the second terminal of the driving circuit 10 to store the threshold voltage in the first energy storage circuit 11.

In the data writing phase, the data writing circuit 13 controls writing a data voltage on the data line Data into the second node C under control of the fourth control signal, thereby correspondingly changing the potential of the first node A.

In the light-emitting phase, the light-emitting control circuit 12 controls conduction between the first terminal of the to-be-driven element D1 and the first terminal of the driving circuit 10 under control of the first control signal, and the light-emitting control circuit 12 controls conduction between the second terminal of the driving circuit 10 and the first voltage terminal V1 under control of the second control signal, thereby enabling the driving circuit 10 to generate a driving current for driving the to-be-driven element D1.

When one embodiment of the pixel circuit shown in FIG. 1 of the present application is in operation, in the data writing phase, the light-emitting control circuit 12 can control conduction between the second terminal of the driving circuit 10 and the first voltage terminal V1.

Figure 2:
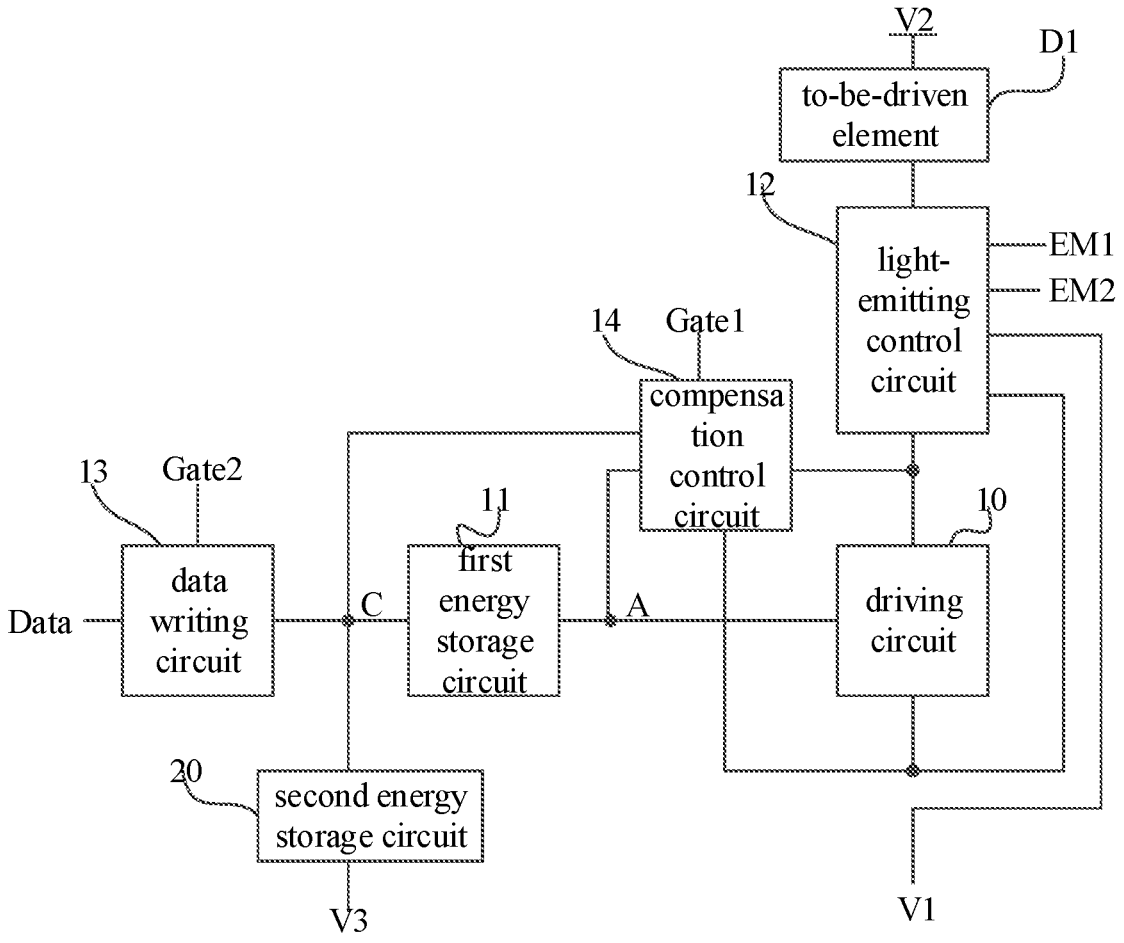
FIG. 2 is a schematic diagram of a pixel circuit according to an embodiment of the present disclosure.

Optionally, as shown in FIG. 2, based on the embodiment of the pixel circuit shown in FIG. 1, the pixel circuit in at least one embodiment of the present application may further include a second energy storage circuit 20. A first terminal of the second energy storage circuit 20 is electrically coupled to the second node C. A second terminal of the second energy storage circuit 20 is electrically coupled to a third voltage terminal V3. The second energy storage circuit 20 is configured to store electrical energy.

In at least one embodiment of the present application, the third voltage terminal may be a low voltage terminal, but is not limited to this.

In at least one embodiment of the pixel circuit shown in FIG. 2, the second energy storage circuit 20 is added. Since the second terminal of the second energy storage circuit 20 is electrically coupled to a DC voltage terminal, the second energy storage circuit 20 can stably maintain the potential of the second node C.

Optionally, the compensation control circuit includes a first transistor and a second transistor.

A control terminal of the first transistor is electrically coupled to the third control terminal. A first terminal of the first transistor is electrically coupled to the second node. A second terminal of the first transistor is electrically coupled to the second terminal of the driving circuit.

A control terminal of the second transistor is electrically coupled to the third control terminal. A first terminal of the second transistor is electrically coupled to the first node. A second terminal of the second transistor is electrically coupled to the first terminal of the driving circuit.

Optionally, the light-emitting control circuit includes a third transistor and a fourth transistor.

A control terminal of the third transistor is electrically coupled to the first control terminal. A first terminal of the third transistor is electrically coupled to the first terminal of the to-be-driven element. A second terminal of the third transistor is electrically coupled to the first terminal of the driving circuit.

A control terminal of the fourth transistor is electrically coupled to the second control terminal. A first terminal of the fourth transistor is electrically coupled to the second terminal of the driving circuit. A second terminal of the fourth transistor is electrically coupled to the first voltage terminal.

Optionally, the data writing circuit includes a fifth transistor.

A control terminal of the fifth transistor is electrically coupled to the fourth control terminal. A first terminal of the fifth transistor is electrically coupled to a data line. A second terminal of the fifth transistor is electrically coupled to the second node.

Optionally, the driving circuit includes a driving transistor, the first energy storage circuit includes a first storage capacitor, and the second energy storage circuit includes a second storage capacitor.

A control terminal of the driving transistor is the control terminal of the driving circuit. A first terminal of the driving transistor is the first terminal of the driving circuit. A second terminal of the driving transistor is the second terminal of the driving circuit.

A first terminal of the first storage capacitor is electrically coupled to the first node. A second terminal of the first storage capacitor is electrically coupled to the second node.

A first terminal of the second storage capacitor is electrically coupled to the second node. A second terminal of the second storage capacitor is electrically coupled to the third voltage terminal.

In at least one embodiment of the present application, the to-be-driven element may be a micro light-emitting diode, but it is not limited thereto.

In one specific implementation, the compensation control circuit includes a first transistor and a second transistor; the light-emitting control circuit includes a third transistor and a fourth transistor; the data writing circuit includes a fifth transistor; and the driving circuit includes a driving transistor. The first transistor, the second transistor, the third transistor, the fourth transistor, the fifth transistor, and the driving transistor may all be n-type transistors, but not limited to this.

Figure 3:
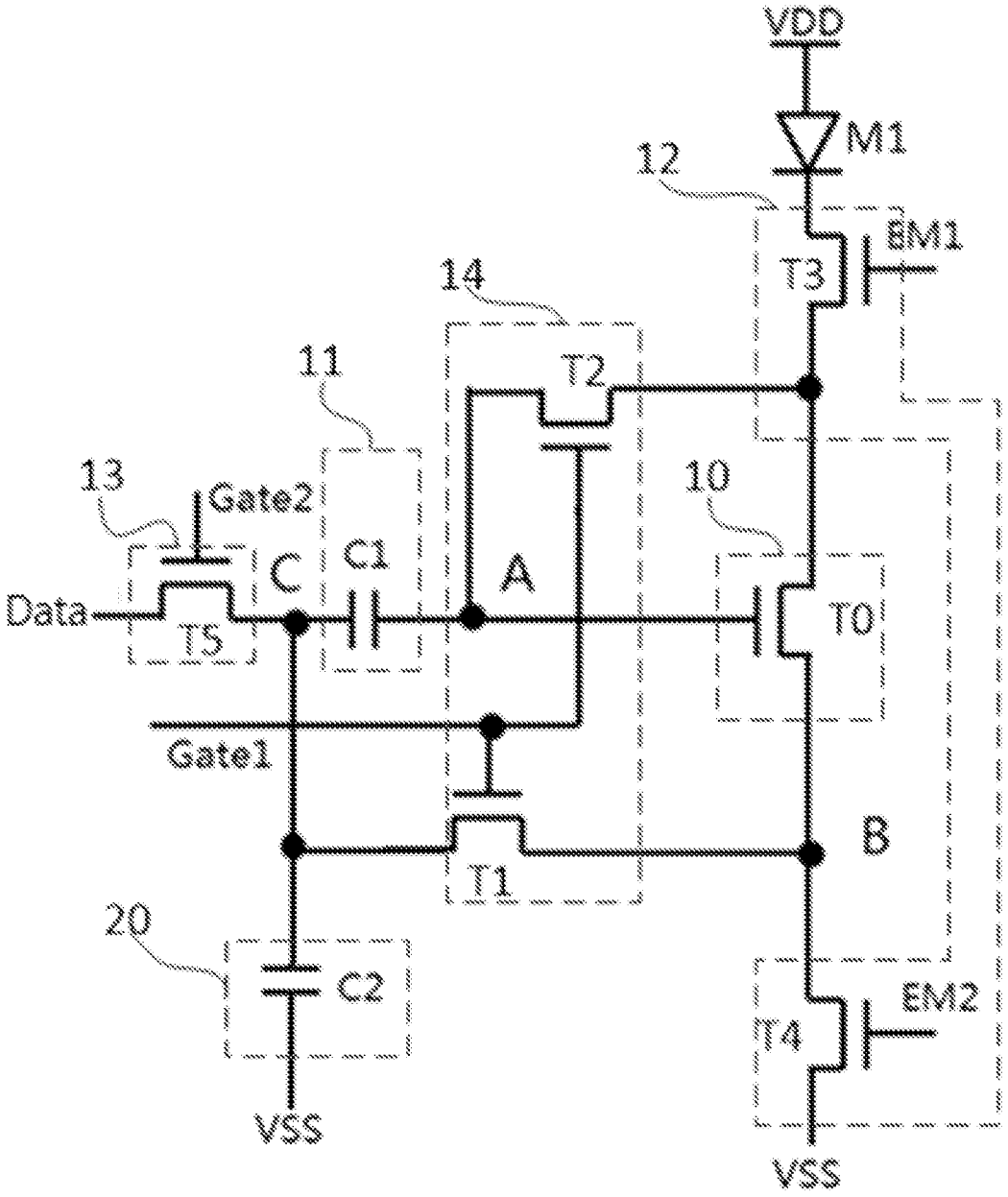
FIG. 3 is a circuit diagram of a pixel circuit according to an embodiment of the present disclosure.

As shown in FIG. 3, based on at least one embodiment of the pixel circuit shown in FIG. 2, the compensation control circuit 14 includes a first transistor T1 and a second transistor T2; the driving circuit 10 includes a driving transistor T0; the light-emitting control circuit 12 includes a third transistor T3 and a fourth transistor T4; the to-be-driven element is a micro light-emitting diode M1; the data writing circuit 13 includes a fifth transistor T5; the first energy storage circuit 11 includes a first storage capacitor C1, and the second energy storage circuit 20 includes a second storage capacitor C2.

A gate electrode of the first transistor T1 is electrically coupled to the third control terminal Gate1. A drain electrode of the first transistor T1 is electrically coupled to the second node C. A source electrode of the first transistor T1 is electrically coupled to a source electrode of the driving transistor T0.

A gate electrode of the second transistor T2 is electrically coupled to the third control terminal Gate1. A drain electrode of the second transistor T2 is electrically coupled to the first node A. A source electrode of the second transistor T2 is electrically coupled to the drain electrode of the driving transistor T0.

A gate electrode of the third transistor T3 is electrically coupled to the first control terminal EM1. A drain electrode of the third transistor T3 is electrically coupled to a cathode of the micro light-emitting diode M1. A source electrode of the third transistor T3 is electrically coupled to the drain electrode of the driving transistor T0. An anode of the micro light-emitting diode M1 is electrically coupled to a high voltage terminal. The high voltage terminal is used to provide a high voltage VDD.

A gate electrode of the fourth transistor T4 is electrically coupled to the second control terminal EM2. A drain electrode of the fourth transistor T4 is electrically coupled to the source electrode of the driving transistor T0. A source electrode of the fourth transistor T4 is electrically coupled to a low voltage terminal. The low voltage terminal is used to provide a low voltage VSS.

A gate electrode of the fifth transistor T5 is electrically coupled to the fourth control terminal Gate2. A drain electrode of the fifth transistor T5 is electrically coupled to the data line Data. A source electrode of the fifth transistor T5 is electrically coupled to the second node C.

The gate electrode of the driving transistor T0 is the control terminal of the driving circuit 10. The drain electrode of the driving transistor T0 is the first terminal of the driving circuit 10. The source electrode of the driving transistor T0 is the second terminal of the driving circuit 10.

A first terminal of the first storage capacitor C1 is electrically coupled to the first node A. A second terminal of the first storage capacitor C1 is electrically coupled to the second node C.

A first terminal of the second storage capacitor C2 is electrically coupled to the second node C. A second terminal of the second storage capacitor C2 is electrically coupled to the low voltage terminal.

In at least one embodiment of the pixel circuit shown in FIG. 3, the second storage capacitor C2 is provided. Since the second terminal of the second storage capacitor C2 is electrically coupled to the low voltage terminal (which is a DC voltage terminal), the second storage capacitor C2 can stably maintain the potential of the second node C.

In at least one embodiment of the pixel circuit shown in FIG. 3, the third node B is a node electrically coupled to the source electrode of the driving transistor T0.

In at least one embodiment of the pixel circuit shown in FIG. 3, all transistors are n-type thin film transistors, and semiconductor layers of all transistors may be made of metal oxide such as indium gallium zinc oxide, or made of c-axis orientation crystalline oxide semiconductor.

In at least one embodiment of the pixel circuit shown in FIG. 3, both the first voltage terminal and the third voltage terminal are low voltage terminals, and the second voltage terminal is a high voltage terminal.

Figure 4:
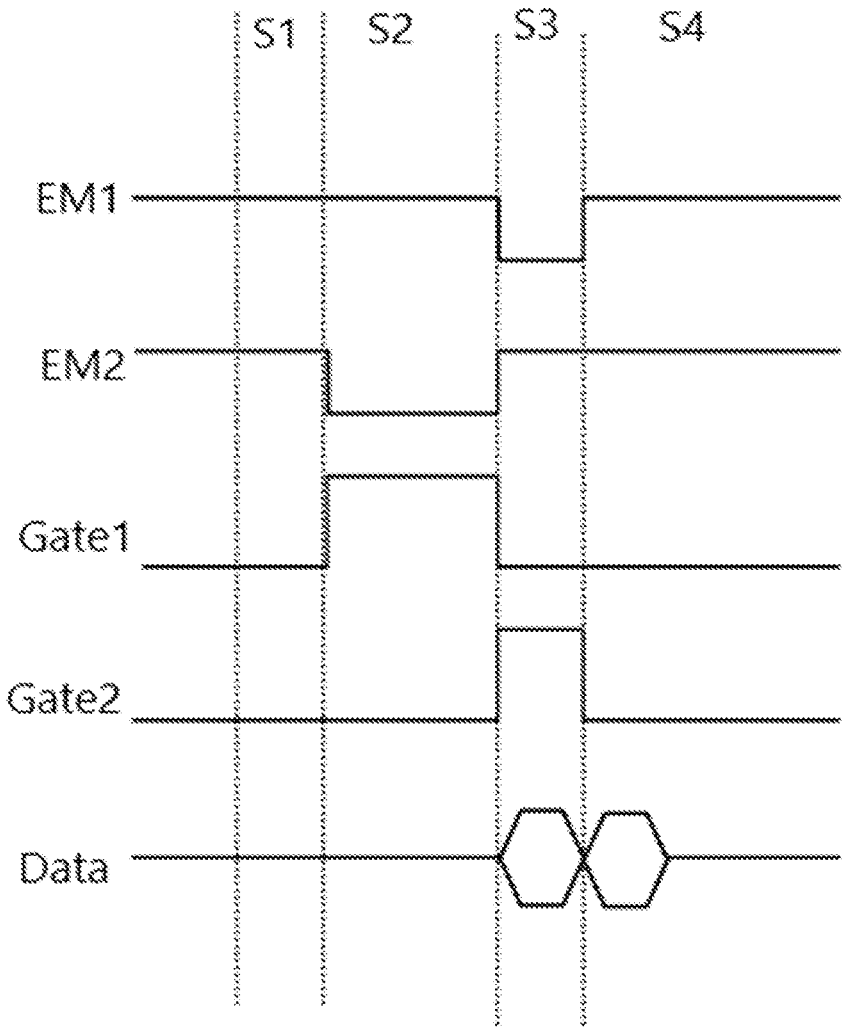
FIG. 4 is a first operation timing diagram of the pixel circuit shown in FIG. 3 according to an embodiment of the present disclosure.

As shown in FIG. 4, when at least one embodiment of the pixel circuit shown in FIG. 3 of the present application is in operation, an operation period may include an initialization phase S1, a compensation phase S2, a data writing phase S3, and a light-emitting phase S4 which are sequentially arranged.

In the initialization phase S1, the first control terminal EM1 provides a high voltage signal, the second control terminal EM2 provides a high voltage signal, the third control terminal Gate1 provides a low voltage signal, the fourth control terminal Gate2 provides a low voltage signal, each of the first transistor T1, the second transistor T2 and the fifth transistor T5 is turned off, both of the third transistor T3 and the fourth transistor T4 are turned on, and the potential of the third node B is initialized to a low voltage.

In the initialization phase S1, the potential of the first node A is maintained at the potential of the first node A in the light-emitting phase S4 in the last operation period, and the potential of the second node B is maintained at the potential of the second node B in the light-emitting phase S4 in the last operation period.

In the compensation phase S2, the first control terminal EM1 provides a high voltage signal, the second control terminal EM2 provides a low voltage signal, the third control terminal Gate1 provides a high voltage signal, the fourth control terminal Gate2 provides a low voltage signal, the third transistor T3 is turned on, the fourth transistor T4 is turned off, the first transistor T1 and the second transistor T2 are turned on, the fifth transistor T5 is turned off; the potential of the first node A changes from the potential of the first node A in the initialization phase S1 to (VDD−Vf), where Vf is a cross voltage of the light-emitting diode M1; and the driving diode T0 is turned on to charge the first storage capacitor C1 and control increase of the potential of the second node C until the driving diode T0 is turned off. At this point, the potential of the second node C becomes (VDD−Vf−Vth), where Vth is a threshold voltage of the driving transistor T0.

In the data writing phase S3, the first control terminal EM1 and the third control terminal Gate1 provide low voltage signals, the second control terminal EM2 and the fourth control terminal Gate2 provide high voltage signals, the third transistor T3 is turned off, the fourth transistor T4 is turned on, the fifth transistor T5 is turned on, the first transistor T1 and the second transistor T2 are turned off; the data line Data provides the data voltage Vdata, and the potential of the second node C becomes Vdata, thereby enabling the potential of the first node A to become (Vdata+Vth).

In the light-emitting phase S4, the first control terminal EM1 and the second control terminal EM2 provide high-voltage signals, the third control terminal Gate1 and the fourth control terminal Gate2 provide low-voltage signals, each of the first transistor T1, the second transistor T2 and the fifth transistor T5 is turned off, both of the third transistor T3 and the fourth transistor T4 are turned on, and the driving diode T0 is turned on to drive the light-emitting diode M1 to emit light. As this point, a current value of the driving current flowing through the light-emitting diode M1 is equal to a*Vdata$^2$, where "a" is a current coefficient of the driving transistor T0.

Figure 5:
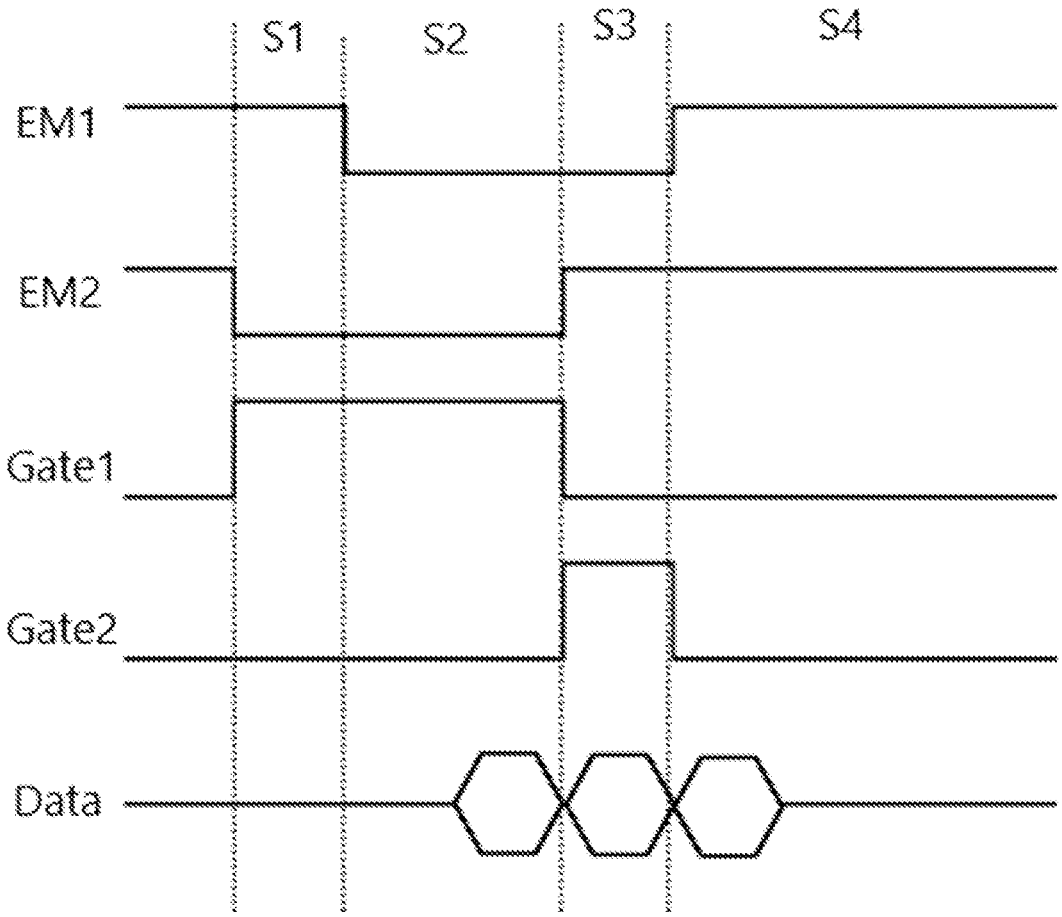
FIG. 5 is a second operation timing diagram of the pixel circuit shown in FIG. 3 according to an embodiment of the present disclosure.

As shown in FIG. 5, when at least one embodiment of the pixel circuit shown in FIG. 3 of the present application is in operation, an operation period may include an initialization phase S1, a compensation phase S2, a data writing phase S3, and a light-emitting phase S4 which are sequentially arranged.

In the initialization phase S1, the first control terminal EM1 and the third control terminal Gate1 provide high voltage signals, the second control terminal EM2 and the fourth control terminal Gate2 provide low voltage signals, each of the third transistor T3, the first transistor T1 and the second transistor T2 is turned on, both of the fourth transistor T4 and the fifth transistor T5 are turned off, thereby controlling the potential of the first node A and the potential of the second node C to be high voltages.

In the compensation phase S2, the first control terminal EM1 provides a low voltage signal, the second control terminal EM2 provides a low voltage signal, the third control terminal Gate1 provides a high voltage signal, the fourth control terminal Gate2 provides a low voltage signal, the third transistor T3 and the fourth transistor T4 are turned off, the first transistor T1 and the second transistor T2 are turned on, and the fifth transistor T5 is turned off. In the compensation phase S2, the driving transistor T0 is turned on, and the potential of the first node A is reduced by discharging until the driving transistor T0 is turned off. At this point, a difference between the potential of the first node A and the potential of the second node C is Vth, where Vth is a threshold voltage of the driving transistor T0.

In the data writing phase S3, the first control terminal EM1 provides a low voltage signal, the second control terminal EM2 provides a high voltage signal, the third control terminal Gate1 provides a low voltage signal, the fourth control terminal Gate2 provides a high voltage signal, the third transistor T3 is turned off, the fourth transistor T4 is turned on, the first transistor T1 and the second transistor T2 are turned off the data line Data outputs the data voltage Vdata, the potential of the second node C becomes Vdata, and the potential of the first node A becomes (Vdata+Vth).

In the light-emitting phase S4, the first control terminal EM1 and the second control terminal EM2 provide high-voltage signals, the third control terminal Gate1 and the fourth control terminal Gate2 provide low-voltage signals, each of the first transistor T1, the second transistor T2 and the fifth transistor T5 is turned off, each of the third transistor T3, the fourth transistor T4 and the driving transistor T0 is turned on; the driving diode T0 drives the light-emitting diode M1 to emit light. At this point, a current value of the driving current I flowing through the light-emitting diode M1 is equal to a*Vdata$^2$, where "a" is a current coefficient of the driving transistor T0.

A driving method in one embodiment of the present application is applied to the foregoing pixel circuit, and an operation period includes a compensation phase, a data writing phase and a light-emitting phase that are sequentially arranged. The driving method includes:

in the compensation phase, storing a threshold voltage of the driving transistor in the driving circuit in the first energy storage circuit under control of the compensation control circuit, thereby enabling a driving current generated by the driving circuit in the light-emitting phase to be independent of the threshold voltage;

in the data writing phase, controlling, by the data writing circuit under control of the fourth control signal, writing a data voltage into the second node, thereby correspondingly changing the potential of the first node;

in the light-emitting phase, controlling, by the light-emitting control circuit under control of the first control signal, conduction between the first terminal of the to-be-driven element and the first terminal of the driving circuit, and controlling, by the light-emitting control circuit under control of the second control signal, conduction between the second terminal of the driving circuit and the first voltage terminal, thereby enabling the driving circuit to generate a driving current for driving the to-be-driven element.

The driving method in the embodiment of the present application can realize compensation of the threshold voltage of the driving transistor included in the driving circuit, thereby realizing the internal compensation function with simple driving sequence.

Optionally, the driving method in at least one embodiment of the present application further includes: in the compensation phase, controlling, by the light-emitting control circuit under control of the first control signal, conduction between the first terminal of the to-be-driven element and the first terminal of the driving circuit.

In the compensation phase, the step of storing a threshold voltage of the driving transistor in the driving circuit in the first energy storage circuit under control of the compensation control circuit, includes:

controlling, by the compensation control circuit under control of the third control signal, conduction between the first node and the first terminal of the driving circuit and conduction between the second node and the second terminal of the driving circuit, thereby enabling the potential of the second node to be related to the threshold voltage of the driving transistor, and storing the threshold voltage of the driving transistor in the first energy storage circuit.

In one specific implementation, in the compensation phase, the light-emitting control circuit controls conduction between the first terminal of the to-be-driven element and the first terminal of the driving circuit under control of the first control signal, and the compensation control circuit controls conduction between the first node and the first terminal of the driving circuit under control of the third control signal, so that the potential of the first node is fixed. The compensation control circuit controls conduction between the second node and the second terminal of the driving circuit under control of the third control signal, thereby charging the first energy storage circuit and increasing the potential of the second node until the driving transistor in the driving circuit is turned off, so that the potential of the second node is related to the threshold voltage of the driving transistor and the threshold voltage of the driving transistor is stored in the first energy storage circuit.

In at least one embodiment of the present application, one operation period may further include an initialization phase before the compensation phase. The driving method further includes:

in the initialization phase, controlling, by the light-emitting control circuit under control of the first control signal, conduction between the first terminal of the to-be-driven element and the first terminal of the driving circuit, and controlling, by the light-emitting control circuit under control of the second control signal, conduction between the second terminal of the driving circuit and the first voltage terminal.

In one specific implementation, the initialization phase may be included before the compensation phase. In the initialization phase, the light-emitting control circuit controls conduction between the first terminal of the to-be-driven element and the first terminal of the driving circuit, and the light-emitting control circuit controls conduction between the second terminal of the driving circuit and the first voltage terminal, thereby initializing the potential of the second terminal of the driving circuit.

Optionally, in the compensation phase, the step of storing a threshold voltage of the driving transistor in the driving circuit in the first energy storage circuit under control of the compensation control circuit, includes:

in the compensation phase, controlling, by the compensation control circuit under control of the third control signal, conduction between the first node and the first terminal of the driving circuit and conduction between the second node and the second terminal of the driving circuit, thereby controlling, in the compensation phase, the driving circuit to turn on connection between the first terminal of the driving circuit and the second terminal of the driving circuit to discharge the first energy storage circuit, until the driving circuit disconnects the connection between the first terminal of the driving circuit and the second terminal of the driving circuit to store the threshold voltage in the first energy storage circuit.

In the pixel driving method according to at least one embodiment of the present application, in the compensation phase, the compensation control circuit controls conduction between the first node and the first terminal of the driving circuit and conduction between the second node and the second terminal of the driving circuit, thereby enabling the driving transistor in the driving circuit to be turned on in the compensation phase to discharge the first energy storage circuit until the driving transistor is turned off.

In one specific implementation, one operation period may further include an initialization phase before the compensation phase. The driving method further includes:

in the initialization phase, controlling, by the light-emitting control circuit under control of the first control signal, conduction between the first terminal of the to-be-driven element and the first terminal of the driving circuit, and controlling, by the compensation control circuit under control of the third control signal, conduction between the first node and the first terminal of the driving circuit and conduction between the second node and the second terminal of the driving circuit, thereby initializing the potential of the first node and the potential of the second node.

One embodiment of the present application provides a display device including the foregoing pixel circuit.

In at least one embodiment of the present application, the display device may include multiple rows and multiple columns of pixel circuits, multiple rows of first light-emitting control lines, multiple rows of second light-emitting control lines, multiple rows of first gate lines, multiple rows of second gates and multiple columns of data lines.

The pixel circuits in the same row can be electrically coupled to the same row of first light-emitting control line, the same row of second light-emitting control line, the same row of first gate line and the same row of second gate. The pixel circuits in the same column can be electrically coupled to the same column of data line.

The first control terminal in the pixel circuit is electrically coupled to the corresponding row of first light-emitting control line. The second control terminal in the pixel circuit is electrically coupled to the corresponding row of second light-emitting control line. The third control terminal in the pixel circuit is electrically coupled to the corresponding row of first fate line. The fourth control terminal in the pixel circuit is electrically coupled to the corresponding row of second gate line.

The display device provided in the embodiment of the present application may be any product or component with a display function, such as a mobile phone, a tablet computer, a television, a monitor, a notebook computer, a digital photo frame, a navigator.

The above are merely the embodiments of the present disclosure and shall not be used to limit the scope of the present disclosure. It should be noted that, a person skilled in the art may make improvements and modifications without departing from the principle of the present disclosure, and these improvements and modifications shall also fall within the scope of the present disclosure. The protection scope of the present disclosure shall be subject to the protection scope of the claims.

What is claimed is:

1. A pixel circuit configured to be coupled to a to-be-driven element, comprising:

a first energy storage circuit;

a driving circuit;

a light-emitting control circuit;

a data writing circuit; and a compensation control circuit;

wherein a first terminal of the first energy storage circuit is electrically coupled to a first node; a second terminal of the first energy storage circuit is electrically coupled to a second node; the first energy storage circuit is configured to store electric energy; the first node is electrically coupled to a control terminal of the driving circuit;

the light-emitting control circuit is respectively coupled to a first control terminal, a second control terminal, a first terminal of the driving circuit, a second terminal of the driving circuit, a first terminal of the to-be-driven element and a first voltage terminal; the light-emitting control circuit is configured to, control conduction between the first terminal of the to-be-driven element and the first terminal of the driving circuit under control of a first control signal provided by the first control terminal, and control conduction between the second terminal of the driving circuit and the first voltage terminal under control of a second control signal provided by the second control terminal; the second terminal of the to-be-driven element is electrically coupled to a second voltage terminal;

the compensation control circuit is electrically coupled to a third control terminal, the first node, the first terminal of the driving circuit, the second node and the second terminal of the driving circuit, respectively; the compensation control circuit is configured to, under control of a third control signal provided by the third control terminal, control conduction between the first node and the first terminal of the driving circuit, and control conduction between the second node and the second terminal of the driving circuit;

the data writing circuit is electrically coupled to a fourth control terminal, a data line and the second node, respectively; the data writing circuit is configured to, under control of a fourth control signal provided by the fourth control terminal, control writing a data voltage provided by the data line into the second node; and the driving circuit is configured to, under control of a potential of the control terminal of the driving circuit, generate a driving current.

2. The pixel circuit of claim 1, further comprising a second energy storage circuit; wherein a first terminal of the second energy storage circuit is electrically coupled to the second node; a second terminal of the second energy storage circuit is electrically coupled to a third voltage terminal; and the second energy storage circuit is configured to store electrical energy.

3. The pixel circuit of claim 1, wherein the compensation control circuit includes a first transistor and a second transistor;

a control terminal of the first transistor is electrically coupled to the third control terminal; a first terminal of the first transistor is electrically coupled to the second node; a second terminal of the first transistor is electrically coupled to the second terminal of the driving circuit;

a control terminal of the second transistor is electrically coupled to the third control terminal; a first terminal of the second transistor is electrically coupled to the first node; a second terminal of the second transistor is electrically coupled to the first terminal of the driving circuit.

4. The pixel circuit of claim 1, wherein the light-emitting control circuit includes a third transistor and a fourth transistor;

a control terminal of the third transistor is electrically coupled to the first control terminal; a first terminal of the third transistor is electrically coupled to the first terminal of the to-be-driven element; a second terminal of the third transistor is electrically coupled to the first terminal of the driving circuit;

a control terminal of the fourth transistor is electrically coupled to the second control terminal; a first terminal of the fourth transistor is electrically coupled to the second terminal of the driving circuit; a second terminal of the fourth transistor is electrically coupled to the first voltage terminal.

5. The pixel circuit of claim 1, wherein the data writing circuit includes a fifth transistor; a control terminal of the fifth transistor is electrically coupled to the fourth control terminal; a first terminal of the fifth transistor is electrically coupled to the data line; a second terminal of the fifth transistor is electrically coupled to the second node.

6. The pixel circuit of claim 5, wherein the driving circuit includes a driving transistor; the first energy storage circuit includes a first storage capacitor; and the second energy storage circuit includes a second storage capacitor;

a control terminal of the driving transistor is the control terminal of the driving circuit; a first terminal of the driving transistor is the first terminal of the driving circuit; a second terminal of the driving transistor is the second terminal of the driving circuit;

a first terminal of the first storage capacitor is electrically coupled to the first node; a second terminal of the first storage capacitor is electrically coupled to the second node;

a first terminal of the second storage capacitor is electrically coupled to the second node; a second terminal of the second storage capacitor is electrically coupled to the third voltage terminal.

7. The pixel circuit of claim 6, wherein the compensation control circuit includes a first transistor and a second transistor;

a control terminal of the first transistor is electrically coupled to the third control terminal; a first terminal of the first transistor is electrically coupled to the second node; a second terminal of the first transistor is electrically coupled to the second terminal of the driving circuit;

a control terminal of the second transistor is electrically coupled to the third control terminal; a first terminal of the second transistor is electrically coupled to the first node; a second terminal of the second transistor is electrically coupled to the first terminal of the driving circuit.

8. The pixel circuit of claim 7, wherein the light-emitting control circuit includes a third transistor and a fourth transistor;

a control terminal of the third transistor is electrically coupled to the first control terminal; a first terminal of the third transistor is electrically coupled to the first terminal of the to-be-driven element; a second terminal of the third transistor is electrically coupled to the first terminal of the driving circuit;

a control terminal of the fourth transistor is electrically coupled to the second control terminal; a first terminal of the fourth transistor is electrically coupled to the second terminal of the driving circuit; a second terminal of the fourth transistor is electrically coupled to the first voltage terminal.

9. The pixel circuit of claim 8, wherein the data writing circuit includes a fifth transistor; a control terminal of the fifth transistor is electrically coupled to the fourth control terminal; a first terminal of the fifth transistor is electrically coupled to the data line; a second terminal of the fifth transistor is electrically coupled to the second node.

10. The pixel circuit of claim 1, wherein the to-be-driven element is a micro light-emitting diode.

11. The pixel circuit of claim 1, wherein the compensation control circuit includes a first transistor and a second transistor; the light-emitting control circuit includes a third transistor and a fourth transistor; the data writing circuit includes a fifth transistor; and the driving circuit includes a driving transistor; the first transistor, the second transistor, the third transistor, the fourth transistor, the fifth transistor, and the driving transistor are all be n-type transistors.

12. A driving method applied to the pixel circuit of claim 1, wherein an operation period includes a compensation phase, a data writing phase, and a light-emitting phase which are sequentially arranged; the method includes:

in the compensation phase, storing a threshold voltage of the driving transistor in the driving circuit in the first energy storage circuit under control of the compensation control circuit;

in the data writing phase, controlling, by the data writing circuit under control of the fourth control signal, writing a data voltage into the second node;

in the light-emitting phase, controlling, by the light-emitting control circuit under control of the first control signal, conduction between the first terminal of the to-be-driven element and the first terminal of the driving circuit, and controlling, by the light-emitting control circuit under control of the second control signal, conduction between the second terminal of the driving circuit and the first voltage terminal, thereby enabling the driving circuit to generate a driving current for driving the to-be-driven element.

13. The method of claim 12, further comprising: in the compensation phase, controlling, by the light-emitting control circuit under control of the first control signal, conduction between the first terminal of the to-be-driven element and the first terminal of the driving circuit;

wherein the step of in the compensation phase, storing a threshold voltage of the driving transistor in the driving circuit in the first energy storage circuit under control of the compensation control circuit, includes:

controlling, by the compensation control circuit under control of the third control signal, conduction between the first node and the first terminal of the driving circuit and conduction between the second node and the second terminal of the driving circuit, thereby enabling a potential of the second node to be related to the threshold voltage of the driving transistor, and storing the threshold voltage of the driving transistor in the first energy storage circuit.

14. The method of claim 13, wherein the operation period further includes an initialization phase before the compensation phase; the method further includes:

in the initialization phase, controlling, by the light-emitting control circuit under control of the first control signal, conduction between the first terminal of the to-be-driven element and the first terminal of the driving circuit, and controlling, by the light-emitting control circuit under control of the second control signal, conduction between the second terminal of the driving circuit and the first voltage terminal.

15. The method of claim 12, wherein the step of in the compensation phase, storing a threshold voltage of the driving transistor in the driving circuit in the first energy storage circuit under control of the compensation control circuit, includes:

in the compensation phase, controlling, by the compensation control circuit under control of the third control signal, conduction between the first node and the first terminal of the driving circuit and conduction between the second node and the second terminal of the driving circuit, thereby controlling, in the compensation phase, the driving circuit to turn on connection between the first terminal of the driving circuit and the second terminal of the driving circuit to discharge the first energy storage circuit, until the driving circuit disconnects the connection between the first terminal of the driving circuit and the second terminal of the driving circuit to store the threshold voltage in the first energy storage circuit.

16. The method of claim 15, wherein the operation period further includes an initialization phase before the compensation phase; the method further includes:

in the initialization phase, controlling, by the light-emitting control circuit under control of the first control signal, conduction between the first terminal of the to-be-driven element and the first terminal of the driving circuit, and controlling, by the compensation control circuit under control of the third control signal, conduction between the first node and the first terminal of the driving circuit and conduction between the second node and the second terminal of the driving circuit, thereby initializing a potential of the first node and a potential of the second node.

17. A display device, comprising: a to-be-driven element and a pixel circuit;

wherein the pixel circuit is coupled to the to-be-driven element; the pixel circuit includes: a first energy storage circuit, a driving circuit, a light-emitting control circuit, a data writing circuit, and a compensation control circuit;

wherein a first terminal of the first energy storage circuit is electrically coupled to a first node; a second terminal of the first energy storage circuit is electrically coupled to a second node; the first energy storage circuit is configured to store electric energy; the first node is electrically coupled to a control terminal of the driving circuit;

the light-emitting control circuit is respectively coupled to a first control terminal, a second control terminal, a first terminal of the driving circuit, a second terminal of the driving circuit, a first terminal of the to-be-driven element and a first voltage terminal; the light-emitting control circuit is configured to, control conduction between the first terminal of the to-be-driven element and the first terminal of the driving circuit under control of a first control signal provided by the first control terminal, and control conduction between the second terminal of the driving circuit and the first voltage terminal under control of a second control signal provided by the second control terminal; the second terminal of the to-be-driven element is electrically coupled to a second voltage terminal;

the compensation control circuit is electrically coupled to a third control terminal, the first node, the first terminal of the driving circuit, the second node and the second terminal of the driving circuit, respectively; the compensation control circuit is configured to, under control of a third control signal provided by the third control terminal, control conduction between the first node and the first terminal of the driving circuit, and control conduction between the second node and the second terminal of the driving circuit;

the data writing circuit is electrically coupled to a fourth control terminal, a data line and the second node, respectively; the data writing circuit is configured to, under control of a fourth control signal provided by the fourth control terminal, control writing a data voltage provided by the data line into the second node; and the driving circuit is configured to, under control of a potential of the control terminal of the driving circuit, generate a driving current.

18. The display device of claim 17, further comprising a second energy storage circuit; wherein a first terminal of the second energy storage circuit is electrically coupled to the second node; a second terminal of the second energy storage circuit is electrically coupled to a third voltage terminal; and the second energy storage circuit is configured to store electrical energy.

19. The display device of claim 17, wherein the compensation control circuit includes a first transistor and a second transistor;

a control terminal of the first transistor is electrically coupled to the third control terminal; a first terminal of the first transistor is electrically coupled to the second node; a second terminal of the first transistor is electrically coupled to the second terminal of the driving circuit;

a control terminal of the second transistor is electrically coupled to the third control terminal; a first terminal of the second transistor is electrically coupled to the first node; a second terminal of the second transistor is electrically coupled to the first terminal of the driving circuit.

20. The display device of claim 19, wherein the light-emitting control circuit includes a third transistor and a fourth transistor;

a control terminal of the third transistor is electrically coupled to the first control terminal; a first terminal of the third transistor is electrically coupled to the first terminal of the to-be-driven element; a second terminal of the third transistor is electrically coupled to the first terminal of the driving circuit;

a control terminal of the fourth transistor is electrically coupled to the second control terminal; a first terminal of the fourth transistor is electrically coupled to the second terminal of the driving circuit; a second terminal of the fourth transistor is electrically coupled to the first voltage terminal;

wherein the data writing circuit includes a fifth transistor; a control terminal of the fifth transistor is electrically coupled to the fourth control terminal; a first terminal of the fifth transistor is electrically coupled to the data line; a second terminal of the fifth transistor is electrically coupled to the second node.

* * * * *